US006484802B1

(12) United States Patent
McGarian et al.

(10) Patent No.: US 6,484,802 B1
(45) Date of Patent: Nov. 26, 2002

(54) DOWNHOLE SCRAPER ASSEMBLY

(75) Inventors: Bruce McGarian, Aberdeen (GB); Ian Gillies, Angus (GB)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/762,252

(22) PCT Filed: Jul. 20, 1999

(86) PCT No.: PCT/GB99/02352

§ 371 (c)(1),
(2), (4) Date: Mar. 16, 2001

(87) PCT Pub. No.: WO00/08300

PCT Pub. Date: Feb. 17, 2000

(30) Foreign Application Priority Data

Aug. 3, 1998 (GB) ..... 9816889

(51) Int. Cl.[7] ..... E21B 37/02
(52) U.S. Cl. ..... 166/173; 166/241.6
(58) Field of Search ..... 166/170, 172, 166/173, 176, 174, 241.2, 241.6

(56) References Cited

U.S. PATENT DOCUMENTS

| | | | | | |
|---|---|---|---|---|---|
| 1,899,269 | A | | 2/1933 | Hakes | |
| 2,735,123 | A | | 2/1956 | Mueller et al. | |
| 3,011,556 | A | | 12/1961 | Best | |
| 4,050,514 | A | | 9/1977 | Prenn | |
| 4,558,738 | A | * | 12/1985 | Howard, Sr. | 166/173 |
| 4,572,291 | A | | 2/1986 | Robison | |
| 4,648,447 | A | | 3/1987 | Bishop et al. | |
| 4,798,246 | A | * | 1/1989 | Best | 166/311 |
| 5,452,760 | A | | 9/1995 | Bertagnolli | |
| 6,152,221 | A | * | 11/2000 | Carmichael et al. | 166/174 |
| 6,182,754 | B1 | * | 2/2001 | Vermeeren | 166/176 |
| 6,209,647 | B1 | * | 4/2001 | Brown, Jr. | 166/311 |

* cited by examiner

*Primary Examiner*—William Neuder
(74) *Attorney, Agent, or Firm*—Dykema Gossett PLLC

(57) ABSTRACT

This invention relates to apparatus for scraping the inner surface of a wellbore. A scraper assembly (2) is provided comprising a scraper element (6) incorporating: a generally cylindrical member defined by a wall having a slot extending through the wall thickness; and at least one tooth member provided on the outer surface of the wall for scraping engagement with a wellbore. The present invention thereby provides a scraper assembly which is relatively convenient and inexpensive to manufacture and which may be considered as a disposable item of downhole equipment.

10 Claims, 4 Drawing Sheets

PRIOR ART

DOWNHOLE SCRAPER ASSEMBLY

BACKGROUND OF THE INVENTION

This invention relates to apparatus for scraping the inner surface of a wellbore.

This invention relates to apparatus for scraping the inner surface of a wellbore.

It is well known in the gas and oil drilling industry to run a scraper assembly down a wellbore so as to clean the inner surface of the wellbore casing wall. This operation is typically undertaken when there is a need to grip the inner surface of the wellbore casing with apparatus such as an inflatable packer. Naturally, the effectiveness of the apparatus gripping the casing is improved if the portion of casing to be gripped is substantially clean and free of loose fragments. In a conventional operation, a scraper assembly is attached to the bottom of the gripping apparatus so that cleaning of the casing may be completed as the gripping apparatus is run to the required depth. The scraping and gripping functions may be thereby executed in a single run.

A conventional scraper assembly is shown in FIG. 1 of the accompanying drawings. Typically, a prior art assembly incorporates a plurality of scraper elements mounted with compression springs about a mandrel. The scraper elements are arranged in such a way as to ensure full circumferential scraping of the casing when the assembly is run downhole without rotation. In the assembly of FIG. 1, this is achieved with the use of three longitudinally spaced pairs of scraper elements which are circumferentially offset relative to each other. A small degree of circumferential overlap is provided between the pairs of scraper elements so as to ensure uninterrupted circumferential scraping. Each scraper element covers approximately 60° of the circumference of wellbore casing to be scraped. The scraper elements of each pair are located on opposite sides of the mandrel and are biased radially into scraping engagement with the wellbore casing by means of compression springs.

A number of problems are associated with the conventional scraper assembly described above. Firstly, the assembly is undesirably long due to the longitudinal spacing of the scraper element pairs. This longitudinal spacing is necessitated by the spring biasing system employed and the need to circumferentially overlap the pairs of scraper elements so as to ensure full scraping of the wellbore. Secondly, the multiple scraper element arrangement results in an item of downhole equipment which is relatively complex and expensive to manufacture.

It is an object of the present invention to provide a downhole scraper assembly which has a relatively short length whilst providing a full circumferential scraping capability.

It is a further object of the present invention to provide a scraper assembly which is relatively convenient and inexpensive to manufacture.

It is yet a further object of the present invention to provide a scraper assembly which is reliable and which is sufficiently inexpensive to manufacture for it to be considered as readily disposable.

SUMMARY OF THE INVENTION

The present invention provides a scraper assembly for use in a wellbore, the scraper assembly comprising a scraper element incorporating: a generally cylindrical member defined by a wall having a slot extending through the wall thickness; and at least one tooth member provided on the outer surface of the wall for scraping engagement with a wellbore, the scraper assembly being characterised in that the slot extends helically along the length of the cylindrical member.

The scraper assembly of the present invention may thereby incorporate only one scraper element to ensure full circumferential scraping. The slot in the wall of the generally cylindrical member allows for radial deflection of the scraper element as the at least one tooth member engages the wellbore. The scraper element is sized so that the maximum diameter of the scraper element (as determined by the at least one tooth member), when in its relaxed state prior to use, is greater than the inner diameter of the wellbore casing to be scraped. Thus, as the scraper assembly of the present invention is pressed downhole, the at least one tooth member is deflected radially inward. The slot allows the radial deflection without undesirable buckling of the scraper element. Furthermore. the arrangement is such that the deflection is elastic. This results in the at least one tooth member applying an appropriate radial force on the wellbore casing during the scraping process.

Preferably, four tooth members are provided on the outer surface of the wall for scraping engagement with a wellbore. It is desirable for the or each tooth member to extend helically about the longitudinal axis of the scraper element. Furthermore, it is preferable for the slot to extend from one end of the generally cylindrical member to the opposite end of the generally cylindrical member. The slot may also extend helically along the length of the generally cylindrical member. It is also desirable for the or each tooth member to be defined on a central portion of the generally cylindrical member so as to provide end portions of the generally cylindrical member for mounting the scraper element adjacent a body member. The mounting of the scraper element adjacent the body member preferably permits radial deformation of the full length of the scraper element.

Furthermore, it is preferable for the scraper element to be configured so that, when radially deformed by a wellbore casing in use, the or each tooth member has a circular or part circular profile when viewed along the longitudinal axis of the scraper element and the outer diameter of this profile is equal to the inner diameter of the wellbore casing.

It is also desirable to provide the scraper element with at least one further slot which extends through the wall thickness, a portion of the at least one further slot extending helically along the scraper element and a portion of the at least one further slot extending in a circumferential direction at each end of the helically extending portion. It may also be preferable to provide at least one groove on the outer surface of the wall, the at least one groove extending helically along the length of the scraper element from one end of the scraper element to the opposite end of the scraper element. This at least one groove provides a fluid way which allows the passage of wellbore fluid past the scraper assembly when in use.

Thus, the scraper assembly of the present invention has the advantage of being relatively short in comparison to conventional scraper assemblies whilst providing a full circumferential scraping capability. Furthermore, since the inherent resilience of the scraper element is harnessed so as to obviate the need for discrete compression springs and since full circumferential scraping is provided by a single scraper element, the scraper assembly of the present invention is relatively convenient and inexpensive to manufacture and may be considered as a disposable item of downhole equipment.

Embodiments of the invention will now be described with reference to the accompanying drawings.

DETAILED DESCRIPTION OF THE PREFERRED EMBODIMENT

In the following description, the longitudinal position of features will be indicated in comparative terms by reference to uphole and downhole locations as interpreted when the described equipment is positioned downhole and orientated for use.

Figure 1:
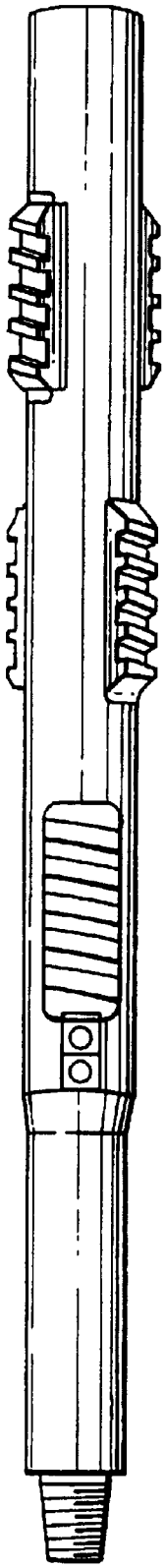
FIG. 1 is a side view of a prior art scraper assembly.
Figure 2:
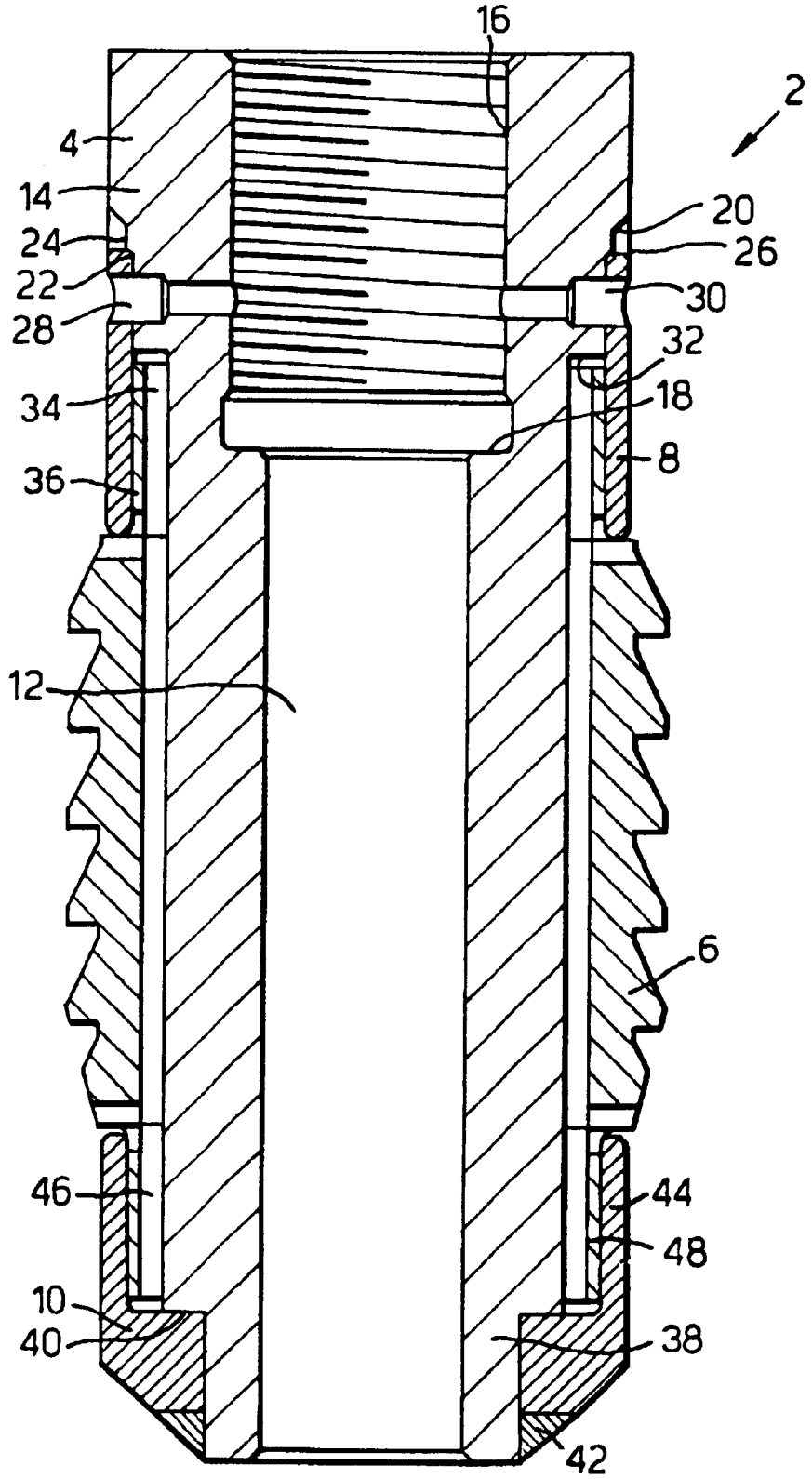
FIG. 2 is a longitudinal cross-section view of a first scraper assembly according to the present invention.

A first embodiment of the present invention is shown in FIG. 2. A scraper assembly 2 is shown as having a mandrel 4, a scraper element 6, a retaining sleeve 8 and a retaining end cap 10. The mandrel 4 is generally cylindrical in shape and has a longitudinal bore 12 extending therethrough. At the uphole end 14 of the scraper assembly 2, the bore 12 is provided with internal screw threads 16 for engagement with downhole equipment such as an inflatable packer or whipstock assembly. The diameter of the bore 12 is reduced by means of an internal shoulder 18 which provides an abutment surface for locating against any equipment engaged with the internal screw threads 16. An arrangement is thereby provided which allows the scraper assembly 2 to be conveniently and rigidly incorporated into a string.

The outer diameter of the mandrel 4 in the region of the uphole end 14 of the scraper assembly 2 is reduced by a first external shoulder 20 and further reduced by a second external shoulder 22. The second external shoulder 22 provides an abutment surface for assisting in locating the retaining sleeve 8 in the correct axial position. When in the correct axial position, the retaining sleeve 8 and the first external shoulder 20 define a recess 24 for receiving a circumferential weld 26. This weld 26 rigidly fixes the retaining sleeve 8 to the mandrel 4.

The axial location of the first and second external shoulders 20,22 is such that, when the retaining sleeve 8 has been welded in position, two diametrically opposed countersunk bores 28,30 may be laterally drilled through the retaining sleeve 8 and the mandrel 4 so as to open on the region of the mandrel bore 12 provided with the internal screw threads 16. Each countersunk bore 28,30 is tapped. In this way, setting screws (not shown) may be received within the countersunk bores 28,30 so as to abut downhole equipment engaged with the internal screw threads 16. Rotation of said downhole equipment relative to the scraper assembly 2 is thereby prevented.

The outer diameter of the mandrel 4 is reduced still further by a third external shoulder 32 located downhole of the counter bores 28,30 but uphole of the downhole end of the retaining sleeve 8. The retaining sleeve 8 is a cylinder having a wall of uniform thickness. Consequently, the portion of the retaining sleeve 8 located downhole of the third external shoulder 32 is radially spaced from the mandrel 4. In the assembled scraper 2, the space 34 receives an uphole end 36 of the scraper element 6.

In the region of the downhole end 38 of the scraper assembly 2, the outer diameter of the mandrel 4 is again reduced by means of a fourth external shoulder 40. The fourth external shoulder 40 provides a surface against which the retaining end cap 10 abuts when in the correct axial position. This position is maintained by means of a weld 42 between the end cap 10 and the mandrel 4. An uphole portion 44 of the end cap 10 defines a cylindrical member having the same wall thickness and outer diameter as that of the retaining sleeve 8. As a result, said end portion 44 is radially spaced from the mandrel 4 and thereby provides a space 46 for receiving a downhole end 48 of the scraper element 6.

Figure 4:
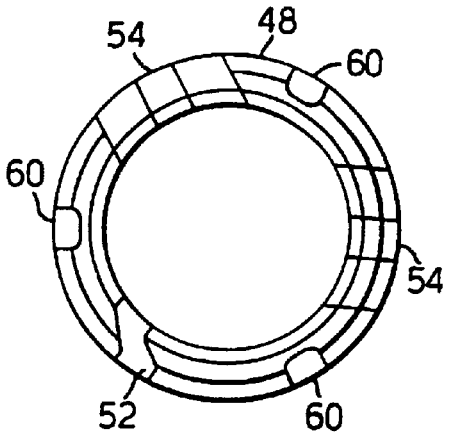
FIG. 4 is an end view of the scraper element of FIG. 3.
Figure 3:
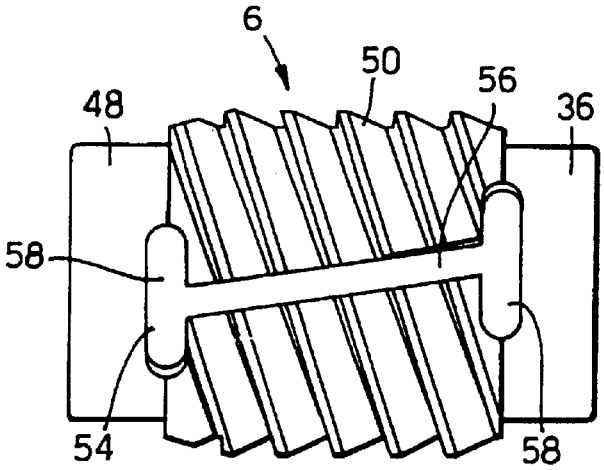
FIG. 3 is a side view of a scraper element provided in the scraper assembly of FIG. 2.

A side view of the scraper element 6 is shown in FIG. 3. The scraper element 6 is generally cylindrical in shape, having an inner diameter greater than the outer diameter of the portion of the mandrel 4 located between the third external shoulder 32 and the fourth external shoulder 40. In the region between the uphole and downhole ends 36, 48 of the scraper element 6, the outer surface of the scraper element 6 is provided with a set of helical scraper blades or teeth 50. The precise configuration of these teeth 50 will be described below in greater detail with reference to FIGS. 5 and 6. A view of the downhole end 48 of the scraper element 6 is shown in FIG. 4 wherein a number of different types of slot are clearly illustrated. Firstly, a single full depth/full length slot 52 is provided. This slot 52 is in the form of a helical cut which completely penetrates the wall thickness of the scraper element 6 and extends the entire length of the element 6, cutting across the blades or teeth 50. Thus, a radial compression force applied to the scraper element 6 will resiliently deform the element 6 and effectively reduce the outer diameter of the element 6. In more precise terms, the scraper element 6 has a lobed shape cross-section rather than a circular cross-section when in a relaxed and undeformed state. It is only when the scraper element 6 is deformed in use so as to partially close (or, depending on the geometry, fully close) the slot 52 that the scraper element 6 forms a cylinder with a generally circular cross-section. In this way, the scraper element 6 conforms to the inner dimensions of the wellbore casing and full circumferential engagement of the teeth 50 with the casing is ensured.

In addition to the full depth/full length slot 52, the scraper element 6 is provided with two "H" shaped slots 54. The two "H" shaped slots 54 are circumferentially offset relative to one another by 120°. Each of these slots 54 penetrates the full wall thickness of the scraper element 6. The cross bar portion 56 of the "H" shape profile extends helically through the region between the uphole and downhole ends 36,48 of the scraper element 6. At each end of the cross bar portion 56, a circumferential portion 58 extends in both circumferential directions to sweep an angle of approximately 60°. The "H" shaped slots 54 function to provide a leaf spring effect when the scraper element 6 is radially deformed in use. The flexibility and resilience of the scraper element 6 is thereby improved.

The scraper element 6 is also provided with three partial depth/full length slots 60. These slots 60 are equispaced about the circumference of the scraper element 6 and are each in the form of a helical groove merely penetrating an outer portion of the wall thickness of the element 6. Each of these slots 60 extends the full length of the scraper element 6. The purpose of the three partial depth/full length slots 60 is to provide fluid ways for wellbore fluid to flow along during use. The helical form of all the slots 52,54,60 is such that the full circumference of the wellbore is scraped by the teeth 50 with mere longitudinal movement of the scraper assembly 2 without the need for rotation.

For a 7.0 inch wellbore casing, the process of manufacturing the scraper element 6 ideally includes the step of turning the scraper element 6 whilst holding the element 6 in a deformed state wherein the full depth/full length slot 52 is sufficiently closed to reduce the outer diameter of the portion of the scraper element 6 provided with the scraper teeth 50 by 0.176 inches. This process ensures a circular profile of the scraper blades 50 when the scraper assembly 2 is downhole in scraping engagement with a wellbore.

Figure 5:
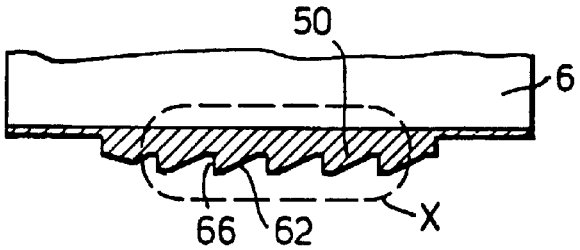
FIG. 5 is a partial longitudinal cross-section view of the scraper element of FIG. 3.
Figure 6:
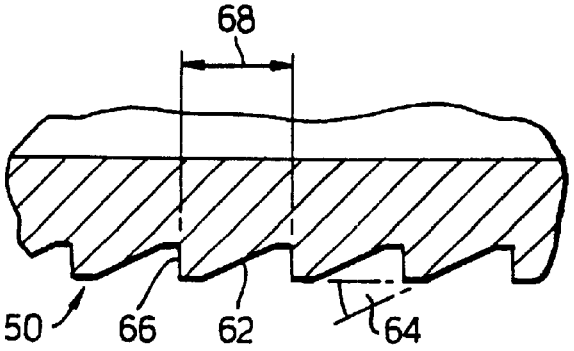
FIG. 6 is a large scale cross-section view of portion X identified in FIG. 5.

The region of the scraper element 6 located between the uphole and downhole ends 36,48 is provided with four scraper teeth 50 which are each arranged helically about the longitudinal axis of the scraper element 6. The helical arrangement of the teeth 50 assists in allowing wellbore fluid to flow past the scraper assembly 2 when in use. A longitudinal cross-section view of the teeth 50 is shown in FIG. 5 and a large scale view of the portion X circled in this figure is shown in FIG. 6. Both FIGS. 5 and 6 show the teeth 50 as having a trailing surface 62 arranged-at an angle 64 to the scraper element 6 longitudinal axis of 25°. These figures also show the teeth 50 as having a leading surface 66 arranged at 90° to the scraper element 6 longitudinal axis. For operation in a 7.0 inch casing, the pitch 68 of the scraper teeth 50 is 1.0 inch. An alternative configuration of the scraper teeth 50 will be apparent to a reader skilled in the art.

Figure 7:
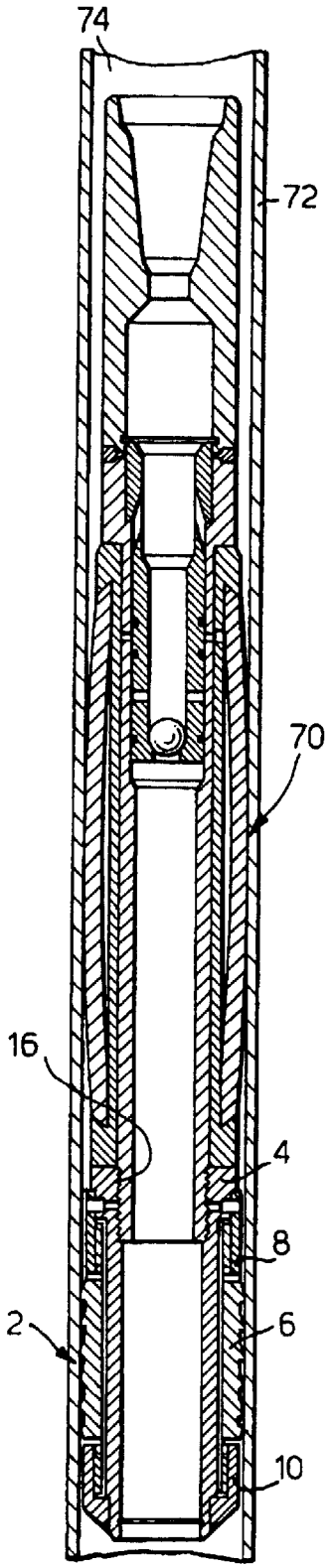
FIG. 7 is a cross-section view of the scraper assembly of FIG. 2 in a downhole location in combination with an inflatable packer.

When in use, the scraper assembly 2 may be threadedly connected to the downhole end of equipment such as an inflatable packer 70 by means of the internal threads 16. The scraper assembly 2 is shown located downhole in combination with an inflatable packer in FIG. 7. In its relaxed state, the scraper element 6 has an outer diameter defined by the teeth 50 which is greater than the inner diameter of the wellbore casing 72. When the scraper assembly 2 and inflatable packer 70 are run downhole, the scraper element 6 is radially deformed by the casing 72. Deformation without undesirable buckling is ensured by means of the slots 52,54,60 provided in the scraper element 6. Furthermore, the scraper element 6 deforms elastically so that the scraper teeth 50 apply radial force on the inner surface 74 of the casing 72. Also, the radial deformation is such that the lobed cross-section of the relaxed scraper element 6 becomes circular. The maximum diameter of the scraper element 6 (i.e. the diameter defined by the scraper teeth 50) thereby becomes equal to the inner diameter of the casing 72. Thus, the scraper teeth 50 engage the full circumference of the casing inner surface 74. Consequently, the entire inner surface 74 of the casing 72 is scraped clean as the scraper assembly 2 is moved down the wellbore. Since the discontinuities in the teeth 50 resulting from the slots 52,54,60 have a helical form, it is not necessary to rotate the scraper assembly 2 to ensure full circumferential scraping. Furthermore, since the scraper assembly 2 is relatively inexpensive to manufacture, the assembly 2 may be discarded once withdrawn from the wellbore or left in the wellbore as part of an inflatable packer or whipstock assembly.

Figure 8:
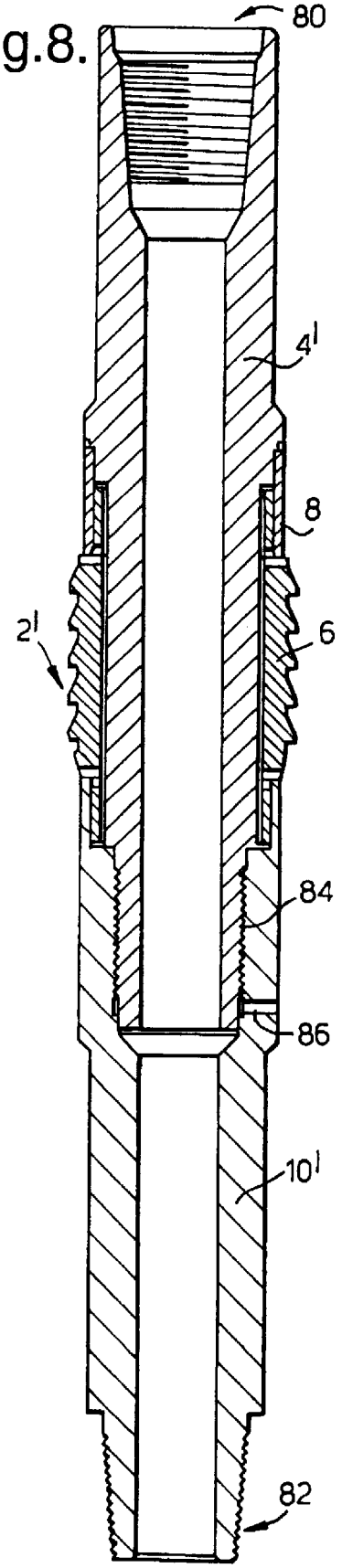
FIG. 8 is a longitudinal cross-section view of a second scraper assembly according to the present invention.

A second embodiment of the present invention is shown in FIG. 8. The components of the scraper assembly 2' shown in this figure differ from the scraper assembly 2 shown in FIG. 2 only in respect of the mandrel 4' and the retaining end cap 10'. The mandrel 4' has an extended uphole portion with conventional female connecting means 80. The end cap 10' has an extended downhole portion with conventional male connecting means 82. These connecting means 80,82 may be employed to integrate the scraper assembly 2' into a string for independent use without an inflatable packer. The retaining end cap 10' is fixed to the mandrel 4' by means of a screw connection 84. The connection 84 is locked by means of a locking screw 86 extending radially through the end cap 10' so as to abut the mandrel 4'. This arrangement is in contrast to the fixing arrangement (i.e. the weld 42) provided in the scraper assembly 2 shown in FIG. 2.

Suitable materials for the construction of the present invention will be apparent to the skilled reader. The invention is not limited to the specific embodiments described above. Alternative arrangements will be apparent to a reader skilled in the art.

What is claimed is:

1. A scraper assembly for use in a wellbore, the scraper assembly comprising a scraper element incorporating:

a generally cylindrical member defined by a wall having a slot extending through the wall thickness; and at least one tooth member provided on the outer surface of the wall and extending circumferentially through an angle of at least 360° for scraping engagement with a wellbore, wherein the slot extends helically along the length of the cylindrical member so as to cut across the or each tooth member.

2. A scraper assembly as claimed in claim 1, wherein four tooth members are provided on the outer surface of the wall for scraping engagement with a wellbore.

3. A scraper assembly as claimed in claim 1, wherein the or each tooth member extends helically about the longitudinal axis of the scraper element.

4. A scraper assembly as claimed in claim 1, wherein the slot extends from one end of the cylindrical member to an opposite end of the cylindrical member.

5. A scraper assembly as claimed in claim 1, wherein the or each tooth member is defined on a central portion of the cylindrical member so as to provide end portions of the cylindrical member, which in use allow the scraper element to be mounted adjacent a body member.

6. A scraper assembly as claimed in claim 5 further comprising a body member adjacent which the scraper element is mounted so as to permit radial deformation of the full length of the scraper element.

7. A scraper element as claimed in claim 1, wherein the scraper element is configured so that, when radially deformed by a wellbore casing in use, the or each tooth member has a circular or part circular profile, the outer diameter of this profile being equal to the inner diameter of the wellbore casing.

8. A scraper assembly as claimed in claim 1, wherein the scraper element is provided with at least one further slot which extends through the wall thickness, one portion of the at least one further slot extending helically along the scraper element and another portion of the at least one further slot extending in circumferential direction at each end of the helically extending portion.

9. A scraper assembly as claimed in claim 1, wherein means are provided for allowing the passage of wellbore fluid past the scraper assembly when in use.

10. A scraper assembly as claimed in claim 9, wherein at least one groove is provided on the outer surface of the wall, the at least one groove extending helically along the length of the scraper element from one end of the scraper element to an opposite end of the scraper element.

* * * * *